US011757213B2

(12) United States Patent
Watkins

(10) Patent No.: US 11,757,213 B2
(45) **Date of Patent: *Sep. 12, 2023**

(54) GROUNDING DEVICE FOR MAINTAINING A GROUND PATH BETWEEN A COMPONENT OF A CONNECTOR AND AN INTERFACE PORT WHEN THE GROUNDING DEVICE FLEXES

(71) Applicant: PPC BROADBAND, INC., East Syracuse, NY (US)

(72) Inventor: Harold J. Watkins, Chittenango, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/968,724

(22) Filed: Oct. 18, 2022

(65) Prior Publication Data

US 2023/0042700 A1 Feb. 9, 2023

Related U.S. Application Data

(63) Continuation of application No. 17/081,559, filed on Oct. 27, 2020, now Pat. No. 11,476,599, which is a continuation of application No. 16/403,488, filed on May 3, 2019, now Pat. No. 10,819,047.

(60) Provisional application No. 62/666,115, filed on May 3, 2018.

(51) Int. Cl.
*H01R 9/05* (2006.01)
*H01R 13/52* (2006.01)

(52) U.S. Cl.
CPC ..... *H01R 9/0521* (2013.01); *H01R 13/5205* (2013.01)

(58) Field of Classification Search
CPC ..... H01R 9/0521; H01R 13/5205
See application file for complete search history.

(56) References Cited

U.S. PATENT DOCUMENTS 7,354,309 B2 * 4/2008 Palinkas ..... H01R 9/0521 439/588
8,858,251 B2 * 10/2014 Montena ..... H01R 13/655 439/322

(Continued)

OTHER PUBLICATIONS

Search Report dated Jul. 25, 2019 in corresponding PCT Application No. PCT/US19/30756, 2 pages.

(Continued)

*Primary Examiner* — Abdullah A Riyami
*Assistant Examiner* — Nader J Alhawamdeh
(74) *Attorney, Agent, or Firm* — MH2 TECHNOLOGY LAW GROUP LLP

(57) ABSTRACT

A grounding device for maintaining a ground path between a component of a connector and an interface port when the grounding device flexes includes a sealing member configured to form a conductive ground path between a component of a connector and an interface port. The sealing member comprises a sealing portion that is configured to overlie a grounding portion toward a radial direction of the connector when the connector is assembled, and the sealing portion and the grounding portion of the sealing member are configured to flex when a force is applied to the sealing member so as to maintain a ground path between the component of the connector and the interface port when the sealing portion and the grounding portion flex and when a force is applied to the sealing member during operation of the connector.

31 Claims, 6 Drawing Sheets

(56) References Cited

U.S. PATENT DOCUMENTS

| | | | | |
|---|---|---|---|---|
| 9,017,101 | B2 * | 4/2015 | Ehret | H01R 9/05 29/874 |
| 9,362,686 | B2 | 6/2016 | Montena et al. | |
| 9,595,776 | B2 * | 3/2017 | Ehret | H01R 13/5025 |
| 10,819,047 | B2 * | 10/2020 | Watkins | H01R 13/035 |
| 2007/0123101 | A1 * | 5/2007 | Palinkas | H01R 9/0521 439/579 |
| 2011/0230089 | A1 * | 9/2011 | Amidon | H01R 13/6593 29/874 |
| 2014/0220805 | A1 | 8/2014 | Haberek | |
| 2015/0180183 | A1 * | 6/2015 | Watkins | H01R 13/6581 439/578 |
| 2019/0334296 | A1 * | 10/2019 | Watkins | H01R 13/622 |
| 2019/0341705 | A1 * | 11/2019 | Watkins | H01R 9/0521 |
| 2020/0274264 | A1 * | 8/2020 | Watkins | H01R 9/0521 |
| 2021/0036459 | A1 * | 2/2021 | Daoust | H01R 9/05 |

OTHER PUBLICATIONS

Written Opinion dated Jul. 25, 2019 in corresponding PCT Application No. PCT/US19/30756, 8 pages.

International Preliminary Report on Patentability dated Nov. 3, 2020 in corresponding PCT Application No. PCT/US19/30756, 9 pages.

* cited by examiner

GROUNDING DEVICE FOR MAINTAINING A GROUND PATH BETWEEN A COMPONENT OF A CONNECTOR AND AN INTERFACE PORT WHEN THE GROUNDING DEVICE FLEXES

CROSS-REFERENCE TO RELATED APPLICATIONS

This is a continuation of U.S. Nonprovisional application Ser. No. 17/081,559 filed on Oct. 27, 2020, which is a continuation of U.S. Nonprovisional application Ser. No. 16/403,488, filed May 3, 2019, now U.S. Pat. No. 10,819,047, which claims the benefit of U.S. Provisional Application No. 62/666,115, filed May 3, 2018, the contents of which are incorporated herein by reference in their entireties.

BACKGROUND

Embodiments of the invention relate generally to data transmission system components, and more particularly to conductive nut seal assemblies for use with a connector of a coaxial cable system component for sealing a threaded port connection, and to a coaxial cable system component incorporating the conductive seal assemblies.

Community antenna television (CATV) systems and many broadband data transmission systems rely on a network of coaxial cables to carry a wide range of radio frequency (RF) transmissions with low amounts of loss and distortion. A covering of plastic or rubber adequately seals an uncut length of coaxial cable from environmental elements such as water, salt, oil, dirt, etc. However, the cable must attach to other cables, components and/or to equipment (e.g., taps, filters, splitters and terminators) generally having threaded ports (hereinafter, "ports") for distributing or otherwise utilizing the signals carried by the coaxial cable. A service technician or other operator must frequently cut and prepare the end of a length of coaxial cable, attach the cable to a coaxial cable connector, or a connector incorporated in a coaxial cable system component, and install the connector on a threaded port. This is typically done in the field. Environmentally exposed (usually threaded) parts of the components and ports are susceptible to corrosion and contamination from environmental elements and other sources, as the connections are typically located outdoors, at taps on telephone poles, on customer premises, or in underground vaults. These environmental elements eventually corrode the electrical connections located in the connector and between the connector and mating components. The resulting corrosion reduces the efficiency of the affected connection, which reduces the signal quality of the RF transmission through the connector. Corrosion in the immediate vicinity of the connector-port connection is often the source of service attention, resulting in high maintenance costs.

Numerous methods and devices have been used to improve the moisture and corrosion resistance of connectors and connections. With some conventional methods and devices, operators may require additional training and vigilance to seal coaxial cable connections using rubber grommets or seals. An operator must first choose the appropriate seal for the application and then remember to place the seal onto one of the connective members prior to assembling the connection. Certain rubber seal designs seal only through radial compression. These seals must be tight enough to collapse onto or around the mating parts. Because there may be several diameters over which the seal must extend, the seal is likely to be very tight on at least one of the diameters. High friction caused by the tight seal may lead an operator to believe that the assembled connection is completely tightened when it actually remains loose. A loose connection may not efficiently transfer a quality RF signal causing problems similar to corrosion.

Other conventional seal designs require axial compression generated between the connector nut and an opposing surface of the port. An appropriate length seal that sufficiently spans the distance between the nut and the opposing surface, without being too long, must be selected. If the seal is too long, the seal may prevent complete assembly of the connector or component. If the seal is too short, moisture freely passes. The selection is made more complicated because port lengths may vary among different manufacturers.

Furthermore, coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference.

Connectors for coaxial cables are typically connected onto complementary interface ports to electrically integrate coaxial cables to various electronic devices and cable communication equipment. Connection is often made through rotatable operation of an internally threaded nut of the connector about a corresponding externally threaded interface port. Fully tightening the threaded connection of the coaxial cable connector to the interface port helps to ensure a ground connection between the connector and the corresponding interface port. However, when the connector is being installed to a mating port and the center conductor of the coaxial cable makes contact with a signal path of the port before a ground path between the connector and the port is established, there may be a signal burst (or burst of noise) that can make its way into the network and be sent back to the headend, causing packet errors, speed issues, and other network issues.

In view of the aforementioned shortcomings and others known by those skilled in the art, it may be desirable to provide a seal and/or a sealing connector that addresses these shortcomings and provides other advantages and efficiencies.

SUMMARY

According to various aspects of the disclosure, a coaxial cable connector includes a connector body configured to receive a coaxial cable, an outer conductor engager configured to make an electrical connection with an outer conductor of the coaxial cable, and a seal assembly. The seal assembly includes a nut and a seal. The nut is configured to make an electrical connection with the outer conductor engager, and the nut has a seal-grasping surface portion. The seal has an elastically deformable tubular body attached to the nut, and the tubular body has a posterior sealing surface that cooperatively engages the seal-grasping surface portion of the housing and a forward sealing surface configured to cooperatively engage an interface port. The seal includes a nonconductive elastomer overlying a conductive elastomer in a radial dimension of the seal. The conductive elastomer is configured to make an electrical ground connection with the interface port before a center conductor of the coaxial cable makes an electrical connection with an internal contact of the interface port when the nut is coupled with the interface port.

In accordance with some aspects of the disclosure, a cable system component includes a nut having a seal-grasping surface portion and a seal having an elastically deformable tubular body attached to the nut. The body has a posterior sealing surface that cooperatively engages the seal-grasping surface portion of the nut and a forward sealing surface configured to cooperatively engage an interface port. The seal includes a nonconductive elastomer overlying a conductive elastomer in a radial dimension of the seal. The conductive elastomer is configured to make an electrical ground connection with the interface port before a center conductor of the coaxial cable makes an electrical connection with an internal contact of the interface port when the nut is coupled with the interface port.

In some aspects of the disclosure, a conductive seal for a cable connector includes a seal configured to form a conductive ground path between a component of the cable connector and an interface port. The seal includes a nonconductive elastomer overlying a conductive elastomer in a radial dimension of the seal. The conductive elastomer is configured to maintain a first conductive ground path portion between the component and the seal and a second conductive ground path portion between the seal and the interface port. The nonconductive elastomer and the conductive elastomer are configured to flex when a force is applied to the seal so as to maintain conductivity of the conductive ground path between the first component and the interface port when the nonconductive elastomer and the conductive elastomer flex and when the force is applied to the seal during operation of the connector.

BRIEF DESCRIPTION OF THE DRAWINGS

Features and advantages of the present disclosure are described in, and will be apparent from, the following Brief Description of the Drawings and Detailed Description.

DETAILED DESCRIPTION OF EMBODIMENTS

Figure 1:
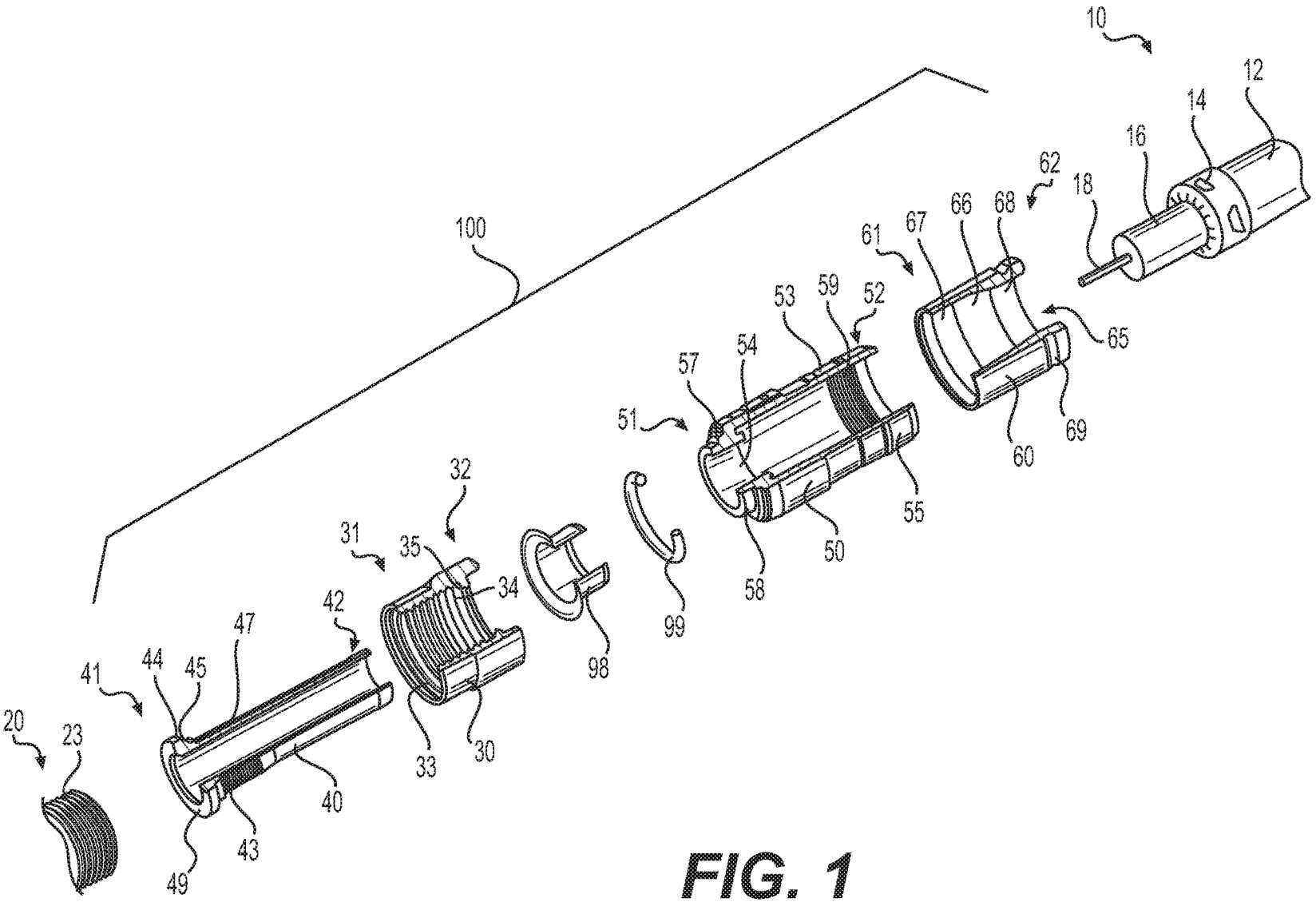
FIG. 1 (PRIOR ART)
FIG. 1 is an exploded perspective cut-away view of a conventional coaxial cable connector.

Embodiments of the invention are directed to a seal assembly for use with a coaxial cable system component and to a coaxial cable system component including a seal assembly in accordance with the described embodiments. Throughout the description, like reference numerals will refer to like parts in the various drawing figures. As a preface to the detailed description, it should be noted that, as used in this specification and the appended claims, the singular forms "a", "an" and "the" include plural referents, unless the context clearly dictates otherwise.

For ease of description, the coaxial cable system components such as connectors, termination devices, filters and the like, referred to and illustrated herein will be of a type and form suited for connecting a coaxial cable or component, used for CATV or other data transmission, to an externally threaded port having a ⅜ inch-32 UNEF 2A thread. Those skilled in the art will appreciate, however, that many system components include a rotatable, internally threaded nut that attaches the component to a typical externally threaded port, the specific size, shape and component details may vary in ways that do not impact the invention per se, and which are not part of the invention per se. Likewise, the externally threaded portion of the port may vary in dimension (diameter and length) and configuration. For example, a port may be referred to as a "short" port where the connecting portion has a length of about 0.325 inches. A "long" port may have a connecting length of about 0.500 inches. All of the connecting portion of the port may be threaded, or there may be an unthreaded shoulder immediately adjacent the threaded portion, for example. In all cases, the component and port must cooperatively engage. According to the embodiments of the present invention, a sealing relationship is provided for the otherwise exposed region between the component connector and the externally threaded portion of the port.

Referring to the drawings, FIG. 1 depicts a conventional coaxial cable connector 100. The coaxial cable connector 100 may be operably affixed, or otherwise functionally attached, to a coaxial cable 10 having a protective outer jacket 12, a conductive grounding shield 14, an interior dielectric 16 and a center conductor 18. The coaxial cable 10 may be prepared as embodied in FIG. 1 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection, such as cuprous braided material, aluminum foils, thin metallic elements, or other like structures. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation, such as plastic foam material, paper materials, rubber-like polymers, or other functional insulating materials. It should be noted that the various materials of which all the various components of the coaxial cable 10 are comprised should have some degree of elasticity allowing the cable 10 to flex or bend in accordance with traditional broadband communication standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIG. 1, the connector 100 may be configured to be coupled with a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's operable electrical interface with the connector 100. However, the receptacle of the port 20 should be formed of a conductive material, such as a metal, like brass, copper, or aluminum. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Referring still further to FIG. 1, the conventional coaxial cable connector 100 may include a coupler, for example, threaded nut 30, a post 40, a connector body 50, a fastener member 60, a continuity member 98 formed of conductive material, and a connector body sealing member 99, such as, for example, a body O-ring configured to fit around a portion of the connector body 50. The nut 30 at the front end of the post 40 serves to attach the connector 100 to an interface port.

The threaded nut 30 of the coaxial cable connector 100 has a first forward end 31 and opposing second rearward end 32. The threaded nut 30 may comprise internal threading 33 extending axially from the edge of first forward end 31 a distance sufficient to provide operably effective threadable contact with the external threads 23 of the standard coaxial cable interface port 20. The threaded nut 30 includes an internal lip 34, such as an annular protrusion, located proximate the second rearward end 32 of the nut. The internal lip 34 includes a surface 35 facing the first forward end 31 of the nut 30. The forward facing surface 35 of the lip 34 may be a tapered surface or side facing the first forward end 31 of the nut 30. The structural configuration of the nut 30 may vary according to differing connector design parameters to accommodate different functionality of a coaxial cable connector 100. For instance, the first forward end 31 of the nut 30 may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end 31 of a nut 30, when mated with the interface port 20. Moreover, the second rearward end 32 of the nut 30 may extend a significant axial distance to reside radially extent, or otherwise partially surround, a portion of the connector body 50, although the extended portion of the nut 30 need not contact the connector body 50. The threaded nut 30 may be formed of conductive materials, such as copper, brass, aluminum, or other metals or metal alloys, facilitating grounding through the nut 30. Accordingly, the nut 30 may be configured to extend an electromagnetic buffer by electrically contacting conductive surfaces of an interface port 20 when a connector 100 is advanced onto the port 20. In addition, the threaded nut 30 may be formed of both conductive and non-conductive materials. For example, the external surface of the nut 30 may be formed of a polymer, while the remainder of the nut 30 may be comprised of a metal or other conductive material. The threaded nut 30 may be formed of metals or polymers or other materials that would facilitate a rigidly formed nut body. Manufacture of the threaded nut 30 may include casting, extruding, cutting, knurling, turning, tapping, drilling, injection molding, blow molding, combinations thereof, or other fabrication methods that may provide efficient production of the component. The forward facing surface 35 of the nut 30 faces a flange 44 of the post 40 when operably assembled in a connector 100, so as to allow the nut to rotate with respect to the other component elements, such as the post 40 and the connector body 50, of the connector 100.

Referring still to FIG. 1, the connector 100 may include a post 40. The post 40 may include a first forward end 41 and an opposing second rearward end 42. Furthermore, the post 40 may include a flange 44, such as an externally extending annular protrusion, located at the first end 41 of the post 40. The flange 44 includes a rearward facing surface 45 that faces the forward facing surface 35 of the nut 30, when operably assembled in a coaxial cable connector 100, so as to allow the nut to rotate with respect to the other component elements, such as the post 40 and the connector body 50, of the connector 100. The rearward facing surface 45 of flange 44 may be a tapered surface facing the second rearward end 42 of the post 40. Further still, an embodiment of the post 40 may include a surface feature 47 such as a lip or protrusion that may engage a portion of a connector body 50 to secure axial movement of the post 40 relative to the connector body 50. However, the post need not include such a surface feature 47, and the coaxial cable connector 100 may rely on press-fitting and friction-fitting forces and/or other component structures having features and geometries to help retain the post 40 in secure location both axially and rotationally relative to the connector body 50. The location proximate or near where the connector body is secured relative to the post 40 may include surface features 43, such as ridges, grooves, protrusions, or knurling, which may enhance the secure attachment and locating of the post 40 with respect to the connector body 50. Moreover, the portion of the post 40 that contacts embodiments of a continuity member 98 may be of a different diameter than a portion of the nut 30 that contacts the connector body 50. Such diameter variance may facilitate assembly processes. For instance, various components having larger or smaller diameters can be readily press-fit or otherwise secured into connection with each other. Additionally, the post 40 may include a mating edge 46, which may be configured to make physical and electrical contact with a corresponding mating edge 26 of the interface port 20. The post 40 should be formed such that portions of a prepared coaxial cable 10 including the dielectric 16 and center conductor 18 may pass axially into the second end 42 and/or through a portion of the tube-like body of the post 40. Moreover, the post 40 should be dimensioned, or otherwise sized, such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 should be conductive and may be formed of metals or may be formed of other conductive materials that would facilitate a rigidly formed post body. In addition, the post may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, combinations thereof, or other fabrication methods that may provide efficient production of the component.

The coaxial cable connector 100 may include a connector body 50. The connector body 50 may comprise a first end 51 and opposing second end 52. Moreover, the connector body may include a post mounting portion 57 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector 100. The internal surface of the post mounting portion 57 may include an engagement feature 54 that facilitates the secure location of the continuity member 98 with respect to the connector body 50 and/or the post 40, by physically engaging the continuity member 98 when assembled within the connector 100. The engagement feature 54 may simply be an annular detent or ridge having a different diameter than the rest of the post mounting portion 57. However other features such as grooves, ridges, protrusions, slots, holes, keyways, bumps, nubs, dimples, crests, rims, or other like structural features may be included to facilitate or possibly assist the positional retention of embodiments of the electrical continuity member 98 with respect to the connector body 50. Nevertheless, embodiments of the continuity member 98 may also reside in a secure position with respect to the connector body 50 simply through press-fitting and friction-fitting forces engendered by corresponding tolerances, when the various coaxial cable connector 100 components are operably assembled, or otherwise physically aligned and attached together. Various exemplary continuity members 98 are illustrated and described in U.S. Pat. No. 8,287,320, the disclosure of which is incorporated herein by reference. In addition, the connector body 50 may include an outer annular recess 58 located proximate or near the first end 51 of the connector body 50. Furthermore, the connector body 50 may include a semi-rigid, yet compliant outer surface 55, wherein an inner surface opposing the outer surface 55 may be configured to form an annular seal when the second end 52 is deformably compressed against a received coaxial cable 10 by operation of a fastener member 60. The connector body 50 may include an external annular detent 53 located proximate or close to the second end 52 of the connector body 50. Further still, the connector body 50 may include internal surface features 59, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, the coaxial cable connector 100 may include a fastener member 60. The fastener member 60 may have a first end 61 and opposing second end 62. In addition, the fastener member 60 may include an internal annular protrusion 63 located proximate the first end 61 of the fastener member 60 and configured to mate and achieve purchase with the annular detent 53 on the outer surface 55 of connector body 50. Moreover, the fastener member 60 may comprise a central passageway 65 defined between the first end 61 and second end 62 and extending axially through the fastener member 60. The central passageway 65 may comprise a ramped surface 66 which may be positioned between a first opening or inner bore 67 having a first diameter positioned proximate with the first end 61 of the fastener member 60 and a second opening or inner bore 68 having a second diameter positioned proximate with the second end 62 of the fastener member 60. The ramped surface 66 may act to deformably compress the outer surface 55 of a connector body 50 when the fastener member 60 is operated to secure a coaxial cable 10. For example, the narrowing geometry will compress squeeze against the cable, when the fastener member is compressed into a tight and secured position on the connector body. Additionally, the fastener member 60 may comprise an exterior surface feature 69 positioned proximate with or close to the second end 62 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate significantly close to the nut 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

The manner in which the coaxial cable connector 100 may be fastened to a received coaxial cable 10 may also be similar to the way a cable is fastened to a common CMP-type connector having an insertable compression sleeve that is pushed into the connector body 50 to squeeze against and secure the cable 10. The coaxial cable connector 100 includes an outer connector body 50 having a first end 51 and a second end 52. The body 50 at least partially surrounds a tubular inner post 40. The tubular inner post 40 has a first end 41 including a flange 44 and a second end 42 configured to mate with a coaxial cable 10 and contact a portion of the outer conductive grounding shield or sheath 14 of the cable 10. The connector body 50 is secured relative to a portion of the tubular post 40 proximate or close to the first end 41 of the tubular post 40 and cooperates, or otherwise is functionally located in a radially spaced relationship with the inner post 40 to define an annular chamber with a rear opening. A tubular locking compression member may protrude axially into the annular chamber through its rear opening. The tubular locking compression member may be slidably coupled or otherwise movably affixed to the connector body 50 to compress into the connector body and retain the cable 10 and may be displaceable or movable axially or in the general direction of the axis of the connector 100 between a first open position (accommodating insertion of the tubular inner post 40 into a prepared cable 10 end to contact the grounding shield 14), and a second clamped position compressibly fixing the cable 10 within the chamber of the connector 100, because the compression sleeve is squeezed into retaining contact with the cable 10 within the connector body 50.

Figure 2B:
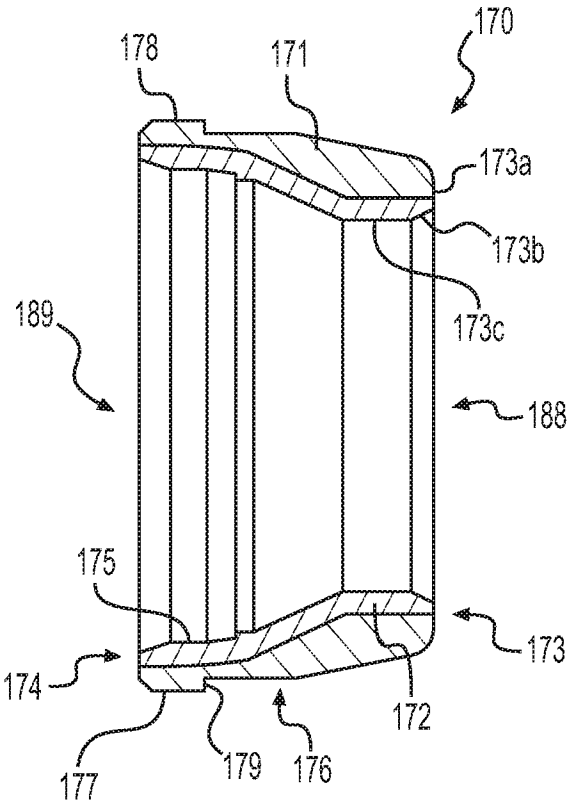
FIGS. 2A and 2B are perspective and side cross-sectional views, respectively, of an exemplary conductive seal in accordance with various aspects of the disclosure.
Figure 2A:
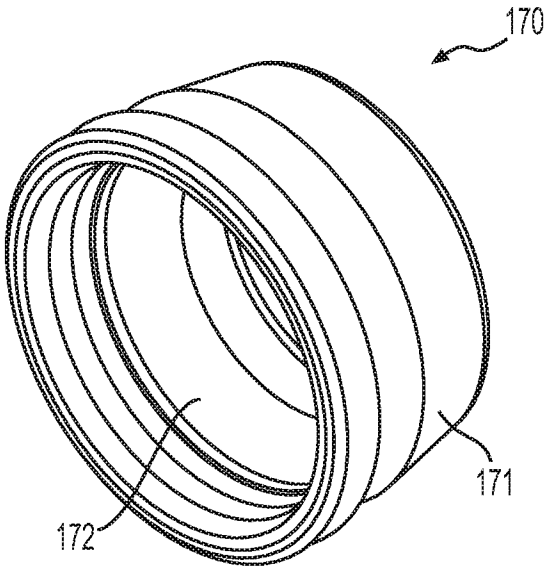
Figure 3:
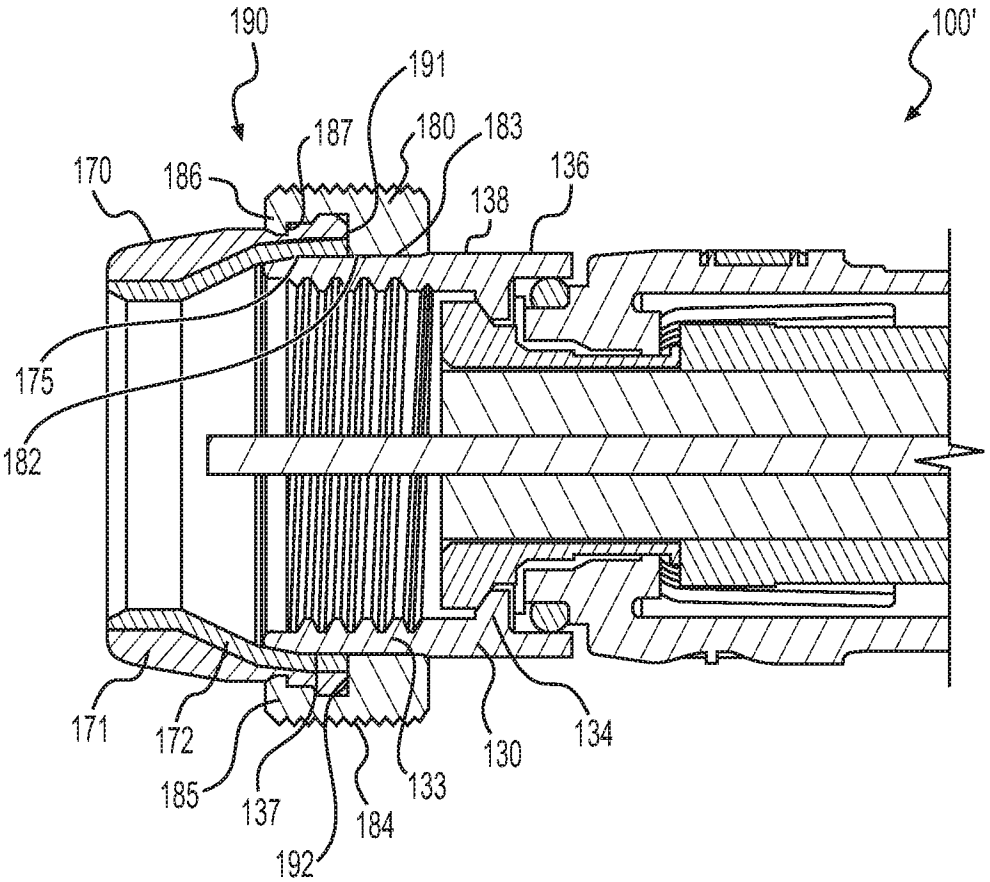
FIG. 3 is a side cross-sectional view of an exemplary conductive nut seal assembly in accordance with various aspects of the disclosure.

As shown in FIGS. 2A, 2B, and 3, an exemplary embodiment of the disclosure is directed to a seal assembly 190 for use with a coaxial connector 100', similar to the conventional coaxial connector 100 described above. The seal assembly 190 includes a nut 130, a seal 170, and a seal ring 180.

The exemplary seal 170 is illustrated in FIGS. 1A, 1B, and 2. The seal 170 has a generally tubular body that is elastically deformable by nature of its material characteristics and design. The seal 170 includes a nonconductive elastomer 171 and a conductive elastomer 172. The nonconductive elastomer 171 may be made of, for example, an elastomeric material having suitable chemical resistance and material stability (i.e., elasticity) over a temperature range between about −40° C. to +40° C. A typical material can be, for example, silicone rubber. Alternatively, the material may be propylene, a typical 0-ring material. Other materials known in the art may also be suitable. The interested reader is referred to http://www.applerubber.com for an exemplary listing of potentially suitable seal materials. The conductive elastomer 172 may be an elastomeric material containing conductive fillers such as, for example, carbon, nickel, and/or silver.

Methods for making the seal 170 include, but are not limited to, co-extruding the nonconductive elastomer 171 and the conductive elastomer 172, overmolding the nonconductive elastomer 171 on the conductive elastomer, and the like. It should be appreciated that conductive elastomers may degrade over time because the fillers cannot stretch (e.g., expand and contract) with the elastomer. Thus, conductive elastomers can become non-conductive over time due to the fillers breaking their chains. However, the nonconductive elastomer 171 maintains it elasticity and helps to keep the fillers of the conductive elastomer 172 together through expansion and contraction. Thus, the nonconductive elastomer improves the overall integrity and durability of the conductive elastomer 172 by improving the tensile strength of the conductive material and preventing the fillers from breaking their chains and thus losing their conductive properties.

The body of seal 170 has an anterior end 188 and a posterior end 189, the anterior end 188 being a free end for ultimate engagement with a port, while the posterior end 189 is for ultimate connection to the nut component 130 of the seal assembly 190. The seal 170 has a forward sealing surface 173 that includes the conductive elastomer 172, a rear sealing portion 174 including an interior sealing surface 175 that integrally engages the nut component 130, and an integral joint-section 176 intermediate the anterior end 188 and the posterior end 189 of the tubular body. The forward sealing surface 173 at the anterior end of the seal 170 may include annular facets 173*a*, 173*b* and 173*c* to assist in forming a seal with the port. Alternatively, forward sealing surface 173 may be a continuous rounded annular surface that forms effective seals through the elastic deformation of the internal surface and end of the seal compressed against the port. The integral joint-section 176 includes a portion of the length of the seal which is relatively thinner in radial cross-section to encourage an outward expansion or bowing of the seal upon its axial compression.

The nut component 130 of the seal assembly 190, illustrated by example in FIG. 3, has an interior surface, at least a portion 133 of which is threaded, a connector-grasping portion 134 (e.g., a lip), and an exterior surface 136 including a seal-grasping surface portion 137. In an aspect, the seal-grasping surface portion 137 can be a flat, smooth surface or a flat, roughened surface suitable to frictionally and/or adhesively engage the interior sealing surface 175 of the seal 170. The exterior surface 136 further includes a nut-turning surface portion 138. In some aspects, the nut-turning surface portion 138 may have at least two flat surface regions that allow engagement with the surfaces of a tool such as a wrench. Typically, the nut-turning surface in this aspect will be hexagonal. Alternatively, the nut turning surface may be a knurled surface to facilitate hand-turning of the nut component.

The seal ring 180 of the seal assembly 190 has an inner surface 182 and an outer surface 184. The inner surface 182 includes a posterior portion 183 having a diameter such that the seal ring 180 is slid over the exterior surface 136 of the nut component 130 and creates a press-fit against the exterior surface 136 of the nut component 130. The rear sealing portion 174 of the seal 170 may include an exterior sealing surface 177 that is configured to integrally engage the seal ring 180. The sealing surface 177 is an annular surface on the exterior of the tubular body. For example, the seal 170 may have a ridge 178 at the posterior end 189 which defines a shoulder 179. The inner surface 182 of the seal ring 180 may include a seal-grasping portion 185. In an aspect, the seal-grasping portion 185 can be a flat, smooth surface or a flat, roughened surface suitable to frictionally and/or adhesively engage the exterior sealing surface 177 of the seal 170. In an aspect, the seal-grasping portion 185 may include a ridge 186 that defines a shoulder 187 that is suitably sized and shaped to engage the shoulder 179 of the ridge 178 of the posterior end 189 of the seal 170 in a locking-type interference fit as illustrated in FIG. 3.

Upon engagement of the seal 170 with the seal ring 180, a posterior sealing surface 191 of the seal 170 abuts a side surface 192 of the nut 130 as shown in FIG. 2 to form a sealing relationship in that region. In its intended use, compressive axial force may be applied against one or both ends of the seal 170 depending upon the length of the port intended to be sealed. The force will act to axially compress the seal whereupon it will expand radially, for example, in the vicinity of the integral joint-section 176. In an aspect, the integral joint-section 176 is located axially asymmetrically intermediate the anterior end 188 and the posterior end 189 of the tubular body, and adjacent an anterior end of the exterior sealing surface 177, as illustrated. However, it is contemplated that the joint-section 176 can be designed to be inserted anywhere between sealing surface 175 and anterior end 188. The seal is designed to prevent the ingress of corrosive elements when the seal is used for its intended function.

It should be appreciated that the connector 100' may be used with various types of ports 20. For example, the connector 100' may be used with a short port, a long port, or an alternate long port. A short port refers to a port having a length of external threads that extends from a terminal end of the port to an enlarged shoulder that is shorter than a length that the seal 170, in an uncompressed state, extends beyond a forward end of the nut 130. When connected to a short port, the seal 170 is axially compressed between a forward facing surface of the seal ring 180 and the enlarged shoulder of the short port. Posterior sealing surface 191 is axially compressed against side surface 192 of nut 130, and the end face 173*a* of forward sealing surface 173 is axially compressed against the enlarged shoulder, thus preventing ingress of environmental elements between the nut 130 and the enlarged shoulder of the port 20.

A long port refers to a port having a length of external threads that extends from a terminal end of the port to an unthreaded portion of the port having a diameter that is approximately equal to the major diameter of external threads. The unthreaded portion then extends from the external threads to an enlarged shoulder. The length of the external threads in addition to the unthreaded portion is longer than the length that the seal 170, in an uncompressed state, extends beyond a forward end of the nut 130. When connected to a long port, the seal 170 is not axially compressed between a forward facing surface of the seal ring 180 and the enlarged shoulder of the short port. Rather, the internal sealing surface 175 is radially compressed against the seal grasping surface portion 137 of the nut 130 by the seal ring 180, and the interior portions 173*b* and 173*c* of forward sealing surface 173 are radially compressed against the unthreaded portion of the long port, thereby preventing the ingress of environmental elements between the nut 130 and the unthreaded portion of the long port. The radial compression of the forward sealing surface 173 against the unthreaded portion of the port is created by an interference fit. An alternate long port refers to a port that is similar to a long port but where the diameter of the unthreaded portion is larger than the major diameter of the external threads.

As described above, the forward sealing surface 173 of the seal 170 includes the conductive elastomer 172, and the forward sealing surface 173 is forward of the center conductor 18. Therefore, regardless of the size of the port, the conductive elastomer 172 of the seal 170 can make contact with the interface port 20 before the center conductor 18 in order to create a ground from the interface port 20 through to the post 140 (which may have an axial length that is shorter than the post 40 illustrated in FIG. 1), by way of the conductive elastomer 172 and the nut 130, and thus limit burst that would otherwise occur upon insertion of the center conductor 18 into the interface port 20 in the absence of a ground. Furthermore, the conductive elastomer 172 of the seal 170 provides port grounding and RF shielding, even when the nut 130 is loosely connected (i.e., not fully tightened) to the interface port 20.

Additionally, abrasion resistance degrades in conductive elastomers. Therefore, the nonconductive elastomer 171 improves the abrasion resistance of the seal 170 relative to the conductive elastomer 172. Of course, the fillers also increase the cost of the conductive elastomer. Thus, by including the nonconductive elastomer 171, the size of the conductive elastomer 172 can be reduced, thereby reducing the cost of the seal 170.

Referring now to FIGS. 4-8, an exemplary embodiment of the disclosure is directed to an annular seal 470, 670, 870 for use with a coaxial connector 100", similar to the conventional coaxial connector 100 described above. The seal 470, 670, 870 includes a nonconductive elastomer 471, 671, 871 and a conductive elastomer 472, 672, 872. The nonconductive elastomer 471, 671, 871 may be made of, for example, an elastomeric material having suitable chemical resistance and material stability (i.e., elasticity) over a temperature range between about −40° C. to +40° C. A typical material can be, for example, silicone rubber. Alternatively, the material may be propylene, a typical O-ring material. Other materials known in the art may also be suitable. The interested reader is referred to http://www.applerubber.com for an exemplary listing of potentially suitable seal materials. The conductive elastomer 472, 672, 872 may be an elastomeric material containing conductive fillers such as, for example, carbon, nickel, and/or silver.

Methods for making the seal 470, 670, 870 include, but are not limited to, co-extruding the nonconductive elastomer 471, 671, 871 and the conductive elastomer 472, 672, 872, overmolding the nonconductive elastomer 471, 671, 871 on the conductive elastomer, and the like. It should be appreciated that conductive elastomers may degrade over time because the fillers cannot stretch (e.g., expand and contract) with the elastomer. Thus, conductive elastomers can become non-conductive over time due to the fillers breaking their chains. However, the nonconductive elastomer 471, 671. 871 maintains it elasticity and helps to keep the fillers of the conductive elastomer 472, 672, 872 together through expansion and contraction. Thus, the nonconductive elastomer 471, 671, 871 improves the overall integrity and durability of the conductive elastomer 472, 672, 872 by improving the tensile strength of the conductive material and preventing the fillers from breaking their chains and thus losing their conductive properties.

Figure 4:
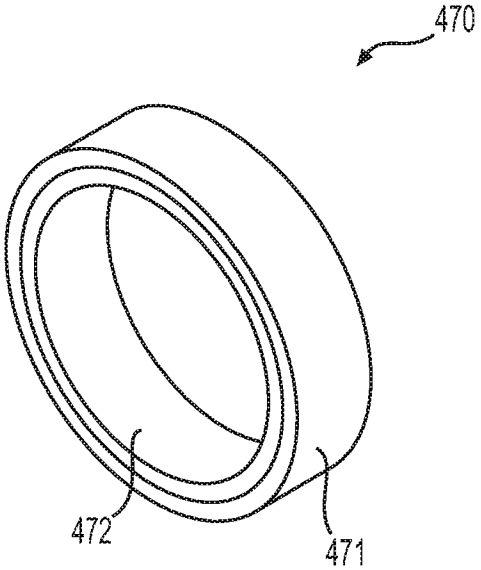
FIG. 4 is a perspective view of an exemplary conductive seal in accordance with various aspects of the disclosure.
Figure 6:
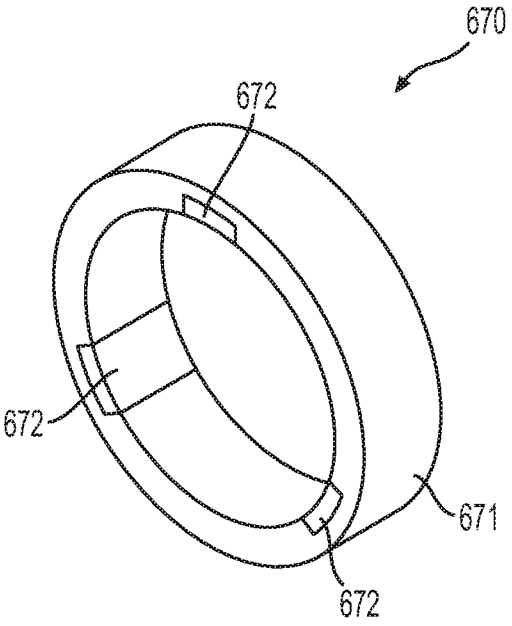
FIG. 6 is a perspective view of an exemplary conductive seal in accordance with various aspects of the disclosure.
Figure 8:
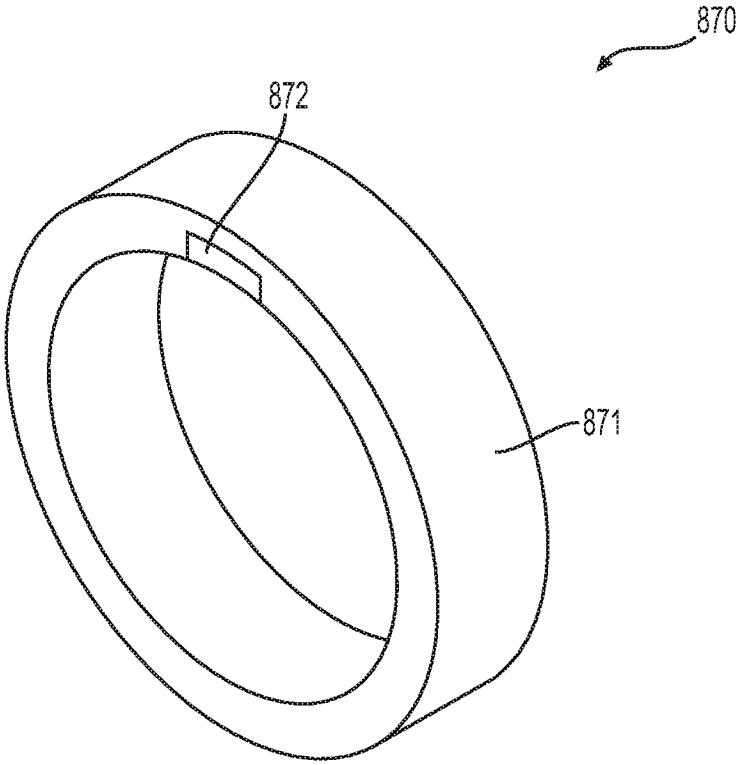
FIG. 8 is a perspective view of an exemplary conductive seal in accordance with various aspects of the disclosure.

As shown in FIG. 4, the nonconductive elastomer 471 and the conductive elastomer 472 may be configured as concentric annular rings. As shown in FIG. 6, the conductive elastomer 672 may be configured as strips that extend in the axial direction and are spaced apart from one another in a circumferential direction. The nonconductive elastomer 671 is configured as an annular ring with slots that are complementary to the strips of the conductive elastomer 672. As shown in FIG. 8, the conductive elastomer 872 may be configured as a single strip that extends in the axial direction. The nonconductive elastomer 871 is configured as an annular ring with a slot that is complementary to the strip of the conductive elastomer 872.

Figure 5:
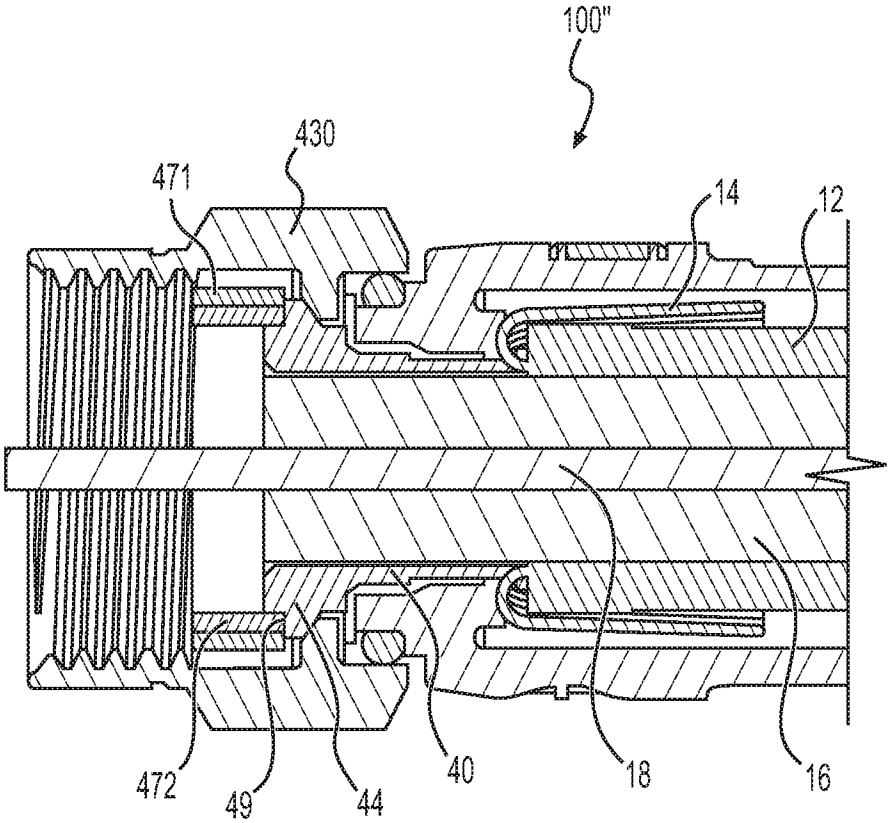
FIG. 5 is a side cross-sectional view of an exemplary conductive nut seal assembly in accordance with various aspects of the disclosure.
Figure 7:
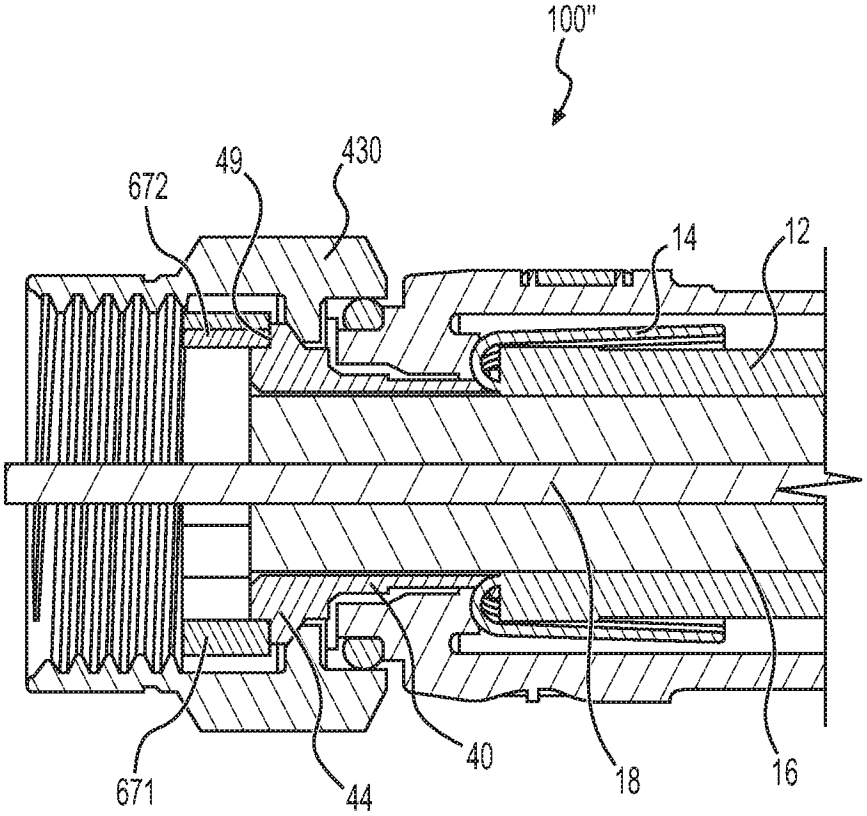
FIG. 7 is a side cross-sectional view of an exemplary conductive nut seal assembly in accordance with various aspects of the disclosure.

Referring to the sectional side views of FIGS. 5 and 7, the connector 100" is configured with the seal 470, 670, 870 proximate the second end 44 of the post 140. The seal 470, 670, 870 may be configured to reside within a nut 430 of the connector 100", while being positioned to physically and electrically contact a mating edge 49 of the post 140. That is, the conductive elastomer 472, 672, 872 should extend the entire axial length of the seal 470, 670, 870 so as to physically and electrically contact the mating edge 49 of the post 140.

The conductive elastomer 472, 672, 872 should exhibit levels of electrical and RF conductivity to facilitate grounding/shielding through the connector 100. Because the conductive elastomer 472, 672, 872 extends the entire axial length of the seal 470, 670, 870, a continuous electrical ground/shielding path may be established between the post 140, the conductive elastomer 472, 672, 872 and the interface port 20 due to the conductive properties shared by the post 140, the conductive elastomer 472, 672, 872 and the port 20, while also forming a seal proximate the mating edge of the post 140.

The seal 470, 670, 870 may facilitate an annular seal between the nut 30 and the post 140, thereby providing a physical barrier to unwanted ingress of moisture and/or other environmental contaminates. Moreover, the seal 470, 670, 870 may facilitate electrical coupling of the post 140 and the nut 30 by extending therebetween an unbroken electrical circuit. In addition, the seal 470, 670, 870 may facilitate grounding of the connector 100, and attached coaxial cable (shown in FIG. 1), by extending the electrical connection between the post 140 and the nut 30. Furthermore, the seal 470, 670, 870 may effectuate a buffer preventing ingress of electromagnetic noise between the nut 30 and the post 140. The seal 470, 670, 870 may be provided to users in an assembled position proximate the second end 44 of post 140, or users may themselves insert the seal 470, 670, 870 into position prior to installation on an interface port 20.

A method for grounding a coaxial cable 10 through a connector 100" is now described with reference to FIGS. 1, 5, and 7. A coaxial cable 10 may be prepared for connector 100 attachment. Preparation of the coaxial cable 10 may involve removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. Various other preparatory configurations of coaxial cable 10 may be employed for use with connector 100" in accordance with standard broadband communications technology and equipment. For example, the coaxial cable may be prepared without drawing back the conductive grounding shield 14, but merely stripping a portion thereof to expose the interior dielectric 16.

With continued reference to FIGS. 1, 5, and 7, further depiction of a method for grounding a coaxial cable 10 through a connector 100" is described. A connector 100" including a post 40, 140 having a first end 42 and second end 44 may be provided. Moreover, the provided connector may include a connector body 50 and a seal 470, 670, 870 located proximate the second end 44 of post 40, 140. The proximate location of the seal 470, 670, 870 should be such that the conductive elastomer 472, 672, 872 makes physical and electrical contact with post 40, 140. In one embodiment, the seal 470, 670, 870 may be inserted into a nut 30 until it abuts the mating edge 49 of post 40, 140. However, other embodiments of connector 100" may locate the seal 470, 670, 870 at or very near the second end 44 of post 40, 140 without insertion of the seal 470, 670, 870 into a nut 30.

Grounding may be further attained by fixedly attaching the coaxial cable 10 to the connector 100". Attachment may be accomplished by inserting the coaxial cable 10 into the connector 100" such that the first end 42 of post 40, 140 is inserted under the conductive grounding sheath or shield 14 and around the dielectric 16. Where the post 40, 140 is comprised of conductive material, a grounding connection may be achieved between the received conductive grounding shield 14 of coaxial cable 10 and the inserted post 40, 140. The ground may extend through the post 40, 140 from the first end 42 where initial physical and electrical contact is made with the conductive grounding sheath 14 to the mating edge 49 located at the second end 44 of the post 40, 140. Once received, the coaxial cable 10 may be securely fixed into position by radially compressing the outer surface 57 of connector body 50 against the coaxial cable 10 thereby affixing the cable into position and sealing the connection. The radial compression of the connector body 50 may be effectuated by physical deformation caused by a fastener member 60 that may compress and lock the connector body 50 into place. Moreover, where the connector body 50 is formed of materials having and elastic limit, compression may be accomplished by crimping tools, or other like means that may be implemented to permanently deform the connector body 50 into a securely affixed position around the coaxial cable 10.

As an additional step, grounding of the coaxial cable 10 through the connector 100 may be accomplished by advancing the connector 100" onto an interface port 20 until a surface of the interface port mates with the conductive elastomer 472, 672, 872 of the seal 470, 670, 870. Because the conductive elastomer 472, 672, 872 is located such that it makes physical and electrical contact with post 40, 140, grounding may be extended from the post 40, 140 through the conductive elastomer 472, 672, 872, and then through the mated interface port 20. Accordingly, the interface port 20 should make physical and electrical contact with the conductive elastomer 472, 672, 872. The seal 470, 670, 870 may function as a conductive seal when physically pressed against the interface port 20. Advancement of the connector 100" onto the interface port 20 may involve the threading on of attached coupling member 30 of connector 100 until a surface of the interface port 20 abuts the conductively coated mating edge member 70 and axial progression of the advancing connector 100" is hindered by the abutment. However, it should be recognized that embodiments of the connector 100" may be advanced onto an interface port 20 without threading and involvement of a coupling member 30. Once advanced until progression is stopped by the conductive sealing contact of the seal 470, 670, 870 with interface port 20, the connector 100" may be shielded from ingress of unwanted electromagnetic interference. Moreover, grounding may be accomplished by physical advancement of various embodiments of the connector 100" wherein the conductive elastomer 472, 672, 872 facilitates electrical connection of the connector 100" and attached coaxial cable 10 to an interface port 20. Furthermore, the conductive elastomer 472, 672, 872 of the seal 470, 670, 870 provides port grounding and RF shielding, even when the nut 30 is loosely connected (i.e., not fully tightened) to the interface port 20.

It should be appreciated that, in some embodiments, the seal 170 may include the conductive elastomer 172 configured as one or more strips, as illustrated in and described with respect to FIGS. 6-8. In other embodiments of the seals 170, 470, 670, 870, the conductive elastomer 172, 472, 672, 872 may overlay the nonconductive elastomer 171, 471, 671, 871.

The accompanying figures illustrate various exemplary embodiments of coaxial cable connectors that provide improved grounding between the coaxial cable, the connector, and the coaxial cable connector interface port. Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

What is claimed is:

1. A grounding device for maintaining a ground path between a component of a connector and an interface port when the grounding device flexes comprising:

a sealing member configured to form a conductive ground path between a component of a connector and an interface port;

wherein the sealing member comprises a sealing portion that is configured to overlie a grounding portion toward a radial direction of the connector when the connector is assembled; and wherein the sealing portion and the grounding portion of the sealing member are configured to flex when a force is applied to the sealing member so as to maintain a ground path between the component of the connector and the interface port when the sealing portion and the grounding portion flex and when a force is applied to the sealing member during operation of the connector.

2. The grounding device of claim 1, wherein the sealing portion comprises a nonconductive elastomer portion.

3. The grounding device of claim 1, wherein the sealing portion comprises a nonconductive elastomer member.

4. The grounding device of claim 1, wherein the grounding portion comprises a conductive elastomer portion.

5. The grounding device of claim 1, wherein the grounding portion comprises a conductive elastomer member.

6. A connector comprising:

the sealing member of claim 1;

wherein the sealing member includes a tubular body having a posterior portion that is configured to be coupled to a coupler that is configured to be electrically coupled to an outer conductor of a coaxial cable, and a forward portion that is configured to engage the interface port; and wherein the grounding portion of the sealing member is configured to provide a port grounding path between the outer conductor of the coaxial cable and the interface port even when the coupler is only loosely connected to the interface port.

7. A connector comprising:

the sealing member of claim 1;

wherein the sealing member includes a tubular body having a posterior portion that is configured to be coupled to a coupler that is configured to be electrically coupled to an outer conductor of a coaxial cable, and a forward portion that is configured to engage the interface port; and wherein the grounding portion of the sealing member is configured to provide a port grounding path between the outer conductor of the coaxial cable and the interface port even when the coupler is not fully tightened to the interface port.

8. A grounding device for maintaining a ground path between a component of a connector and an interface port when the grounding device flexes comprising:

a flexing ground member configured to form a conductive ground path between a component of a connector and an interface port when a force is applied to the flexing ground member during operation of the connector;

wherein the flexing ground member comprises an overlying portion that is configured to overlie a grounding portion toward a radial direction of the connector when the connector is assembled; and wherein the overlying portion and the grounding portion of the flexing ground member are configured to flex when the force is applied to the flexing ground member so as to maintain a ground path between the component of the connector and the interface port when the overlying portion and the grounding portion flex and when the force is applied to the flexing ground member during operation of the connector.

9. The grounding device of claim 8, wherein the overlying portion comprises a nonconductive elastomer sealing portion.

10. The grounding device of claim 8, wherein the overlying portion comprises a nonconductive elastomer member.

11. The grounding device of claim 8, wherein the grounding portion comprises a conductive elastomer portion.

12. The grounding device of claim 8, wherein the grounding portion comprises a conductive elastomer member.

13. A connector comprising:

the flexing ground member of claim 8;

wherein the flexing ground member includes a tubular body having a posterior portion that is configured to be coupled to a coupler that is configured to be electrically coupled to an outer conductor of a coaxial cable, and a forward portion that is configured to engage the interface port; and wherein the grounding portion of the flexing ground member is configured to provide a port grounding path between the outer conductor of the coaxial cable and the interface port even when the coupler is only loosely connected to the interface port.

14. A connector comprising:

the sealing member of claim 8;

wherein the flexing ground member includes a tubular body having a posterior portion that is configured to be coupled to a coupler that is configured to be electrically coupled to an outer conductor of a coaxial cable, and a forward portion that is configured to engage the interface port; and wherein the grounding portion of the flexing ground member is configured to provide a port grounding path between the outer conductor of the coaxial cable and the interface port even when the coupler is not fully tightened to the interface port.

15. A connector for maintaining a ground path with an interface port when a flexing ground member flexes during operation of the connector comprising:

a flexing ground member configured to form a conductive ground path between a component of a connector and an interface port when a force is applied to the flexing ground member during operation of the connector;

wherein the flexing ground member comprises an overlying portion that is configured to overlie a grounding portion toward a radial direction of the connector when the connector is assembled; and wherein the overlying portion and the grounding portion of the flexing ground member are configured to flex when the force is applied to the flexing ground member so as to maintain a ground path between the component of the connector and the interface port when the overlying portion and the grounding portion flex and when the force is applied to the flexing ground member during operation of the connector.

16. The connector of claim 15, wherein the overlying portion comprises a nonconductive elastomer sealing portion.

17. The connector of claim 15, wherein the overlying portion comprises a nonconductive elastomer member.

18. The connector of claim 15, wherein the grounding portion comprises a conductive elastomer portion.

19. The connector of claim 15, wherein the grounding portion comprises a conductive elastomer member.

20. The connector of claim 15, wherein the flexing ground member includes a tubular body having a posterior portion that is configured to be coupled to a coupler that is configured to be electrically coupled to an outer conductor of a coaxial cable, and a forward portion that is configured to engage the interface port; and wherein the grounding portion of the flexing ground member is configured to provide a port grounding path between the outer conductor of the coaxial cable and the interface port even when the coupler is only loosely connected to the interface port.

21. The connector of claim 15, wherein the flexing ground member includes a tubular body having a posterior portion that is configured to be coupled to a coupler that is configured to be electrically coupled to an outer conductor of a coaxial cable, and a forward portion that is configured to engage the interface port; and wherein the grounding portion of the flexing ground member is configured to provide a port grounding path between the outer conductor of the coaxial cable and the interface port even when the coupler is not fully tightened to the interface port.

22. A coaxial cable connector, comprising:

a sealing assembly that includes a tubular body having a posterior portion that is configured to be coupled to a coupler that is configured to be electrically coupled to an outer conductor of a coaxial cable, and a forward portion that is configured to engage an interface port;

wherein the sealing assembly includes a sealing portion and a grounding portion;

wherein the sealing portion is configured to overlie a grounding portion toward a radial dimension of the sealing assembly when the connector is assembled; and wherein the grounding portion of the sealing assembly is configured to provide a port grounding path between the outer conductor of a coaxial cable and the interface port even when the coupler is only loosely connected to the interface port.

23. The connector of claim 22, wherein the sealing portion comprises a nonconductive elastomer portion.

24. The connector of claim 22, wherein the sealing portion comprises a nonconductive elastomer member.

25. The connector of claim 22, wherein the grounding portion comprises a conductive elastomer portion.

26. The connector of claim 22, wherein the grounding portion comprises a conductive elastomer member.

27. A coaxial cable connector comprising:

a body member having a posterior portion that is configured to be coupled to a coupler that is configured to be electrically coupled to an outer conductor of a coaxial cable, and a forward portion that is configured to engage an interface port;

a flexing ground member that includes an overlying portion that is configured to overlie a grounding portion toward a radial direction of the connector when the connector is assembled; and wherein the grounding portion of the flexing ground member is configured to provide a port grounding path between the outer conductor of a coaxial cable and the interface port even when the coupler is only loosely connected to the interface port.

28. The connector of claim 27, wherein the overlying portion comprises a nonconductive elastomer sealing portion.

29. The connector of claim 27, wherein the overlying portion comprises a nonconductive elastomer sealing member.

30. The connector of claim 27, wherein the grounding portion comprises a conductive elastomer portion.

31. The connector of claim 27, wherein the grounding portion comprises a conductive elastomer member.

* * * * *